United States Patent [19]

Karstensen

[11] 4,251,185

[45] Feb. 17, 1981

[54] EXPANSION CONTROL RING FOR A TURBINE SHROUD ASSEMBLY

[75] Inventor: Karl W. Karstensen, Peoria, Ill.

[73] Assignee: Caterpillar Tractor Co., Peoria, Ill.

[21] Appl. No.: 902,016

[22] Filed: May 1, 1978

[51] Int. Cl.[3] ..... F01D 11/08

[52] U.S. Cl. ..... 415/136; 415/113; 415/175

[58] Field of Search ..... 415/136, 110, 113, 116, 415/126, 134, 174, 175; 416/190, 191

[56] References Cited

U.S. PATENT DOCUMENTS

| | | | |
|---|---|---|---|
| 2,488,867 | 11/1949 | Judson | 415/136 |
| 2,685,429 | 8/1954 | Auyer | 415/110 |
| 2,962,256 | 11/1960 | Bishop | 415/136 |
| 3,141,651 | 7/1964 | Moyer | 415/136 |
| 3,391,904 | 7/1968 | Albert et al. | 415/116 |
| 3,807,891 | 4/1974 | McDow et al. | 415/138 |
| 3,959,966 | 6/1976 | Pearce et al. | 415/139 |
| 3,966,356 | 6/1976 | Irwin | 415/113 |
| 3,975,901 | 8/1976 | Hallinger et al. | 415/115 |
| 3,986,720 | 10/1976 | Knudsen et al. | 415/136 |
| 3,990,807 | 11/1976 | Sifford | 415/136 |
| 4,023,731 | 5/1977 | Patterson | 415/116 |
| 4,023,919 | 5/1977 | Patterson | 415/134 |
| 4,050,843 | 9/1977 | Needham et al. | 415/116 |
| 4,157,232 | 6/1979 | Bobo et al. | 415/116 |

FOREIGN PATENT DOCUMENTS

| | | | |
|---|---|---|---|
| 2422533 | 12/1974 | Fed. Rep. of Germany | 415/136 |
| 790854 | 2/1958 | United Kingdom | 415/136 |

*Primary Examiner*—Everette A. Powell, Jr.
*Assistant Examiner*—A. N. Trausch, III
*Attorney, Agent, or Firm*—Phillips, Moore, Weissenberger, Lempio & Majestic

[57] ABSTRACT

A turbine shroud assembly includes an expansion control ring to support segmented rotor shrouds. The expansion control ring is restrained by adjacent manifold rings, yet free to thermally expand radially outwardly without loss of axial alignment with the associated turbine wheel. The ported manifold rings are positioned on either side of an outwardly extending leg of the expansion control ring to direct cooling fluid delivered thereto toward the expansion control ring. A spacer ring surrounds the expansion control ring and restrains the expansion control ring relative to the manifold rings. The spacer ring maintains axial alignment of the expansion control ring with the turbine wheel. Cooling fluid is exhausted into the main hot gas stream, both upstream and downstream of the turbine wheel thus substantially preventing hot gases from affecting the expansion control ring.

9 Claims, 5 Drawing Figures

EXPANSION CONTROL RING FOR A TURBINE SHROUD ASSEMBLY

BACKGROUND OF THE INVENTION

This invention relates to a shroud assembly for a turbine engine. In particular, it relates to cooling of a shroud assembly in a gas turbine engine.

Cooling of the shroud surrounding the turbine wheel in a turbine, presents rather unique problems. The shroud surrounding the turbine blades must be in close proximity to the blades in order to maintain efficiency in the turbine engine. Notwithstanding temperature, the turbine wheel must rotate freely, both at start up and during operation. It is a characteristic of turbine engines that the turbine wheel operates at a relatively high temperature. Similarly the shrouds surrounding the turbine wheel operate at a relatively high temperature. It usually is a characteristic of turbines that the material from which the turbine wheel and turbine wheel blades are made will expand at a differing rate than the surrounding shroud structure. Although it would be possible to make the turbine wheel and blades of the same material as the shroud structure, heating of the two elements of the turbine (i.e. the wheel/blades and the shroud) will differ. Experience shows that the shroud usually operates at a higher temperature than the turbine wheel. Therefore, if the two elements are made of the same material, the shroud will expand at a faster rate and finally obtain a relatively larger inside diameter than the outside diameter of the steady state expanded turbine wheel. In this situation, some of the hot fluid powering the turbine wheel will bypass the turbine blades and further may cause unnecessary turbulence in the vicinity of the turbine blades, thus resulting in excessive fuel consumption.

Accordingly, it is desireable to provide cooling in the vicinity of the turbine shroud to decrease the difference in expansion between the turbine shroud and the turbine wheel and blades. Cooling fluid for turbine engines of the gas turbine type used in propelling aircraft is readily available either from atmospheric air flow over an uninsulated engine case, or bleed air from the compressor, or, in the case of a turbofan engine, air bled from the fan.

In an industrial gas turbine engine of the embodiment of this invention, atmospheric air or fan bleed air is not available. Furthermore, the engine case in an industrial gas turbine engine is generally heavily insulated to prevent heat loss within the engine itself, thus ambient air is of little use. Compressed air flow from the compressor stage of an industrial gas turbine engine is usually communicated directly to a heat exchanger. The heat exchanger serves two purposes, first to warm the incoming air for subsequent combustion in the gas turbine itself and secondly, to cool the exhaust gases before discharge into the atmosphere. It is impractical to utilize the compressed air from the heat exchanger with its recuperated heat for cooling of the turbine shroud since the temperature of this air is excessive. On the other hand, air may be bled directly from the compressor stage and communicated through appropriate manifolding to cool the various gasifier turbine parts. This compressor bleed air has a relatively cool temperature established primarily by the compression ratio, and secondarily by conduction from the hot engine case.

Use of bleed air from the turbine compressor should be limited in order to achieve the highest degree of engine efficiency. In earlier industrial gas turbine engines, air was supplied in a random manner to the shroud structure surrounding the turbine blades. Furthermore, the material utilized in earlier shroud structures was usually chosen primarily for its strength with secondary attention paid the coefficient of thermal expansion.

Furthermore, in earlier industrial gas turbine engines wherein the cooling air was provided in an haphazard fashion to the shroud rings, no attempt was made to isolate the cooling air from the surrounding hot structure thus; by the time the cooling air arrived at the shroud structure, a good deal of its cooling potential had been lost due to temperature increases through contact with hot surfaces of the gas turbine engine. Finally, the large plenum chamber arrangement involved in earlier gas turbine engines resulted in a drop in pressure of the cooling air to the extent that hot gas was able to enter the plenum chamber and further degrade the cooling.

Attempts to maintain a smooth gas flow through the turbine and past the turbine wheel, resulted in the turbine shroud essentially being made an integral part of the turbine casing. Thus, the adjacent relatively high temperatures of the turbine casing were conducted to the turbine shroud with a concomitant expansion of the turbine shroud. Even though attempts have been made to restrain the expansion of the turbine shroud, efforts along this line have not been entirely successful. To compound the problem, reduction in a diameter or maintenance of the same diameter of the turbine shroud ring resulting from impingement of cooling air thereon was resisted by the mechanical restraints imposed on the turbine shroud ring by expansion of the hotter portions of the turbine engine casing.

Finally, earlier gas turbine engines, both of the industrial type and the aircraft type, usually used an overlapping segmented shroud assembly to permit thermal expansion within each segment while not substantially increasing the inside diameter of the entire shroud structure. These individual shroud segments were mounted in various ways with cooling air usually directed toward them in the aforedescribed haphazard manner. A possible disadvantage resulted from such a structure. A true circular opening for the turbine wheel was difficult to achieve because of the segmented nature of the shroud assemblies themselves. Therefore, the clearance between the turbine shroud assembly and a turbine blade had to be adjusted to account for a possible out of round condition. This adjustment resulted in an unnecessary loss of efficiency.

SUMMARY OF THE INVENTION

The present invention is directed to overcoming one or more of the problems as set forth above.

Broadly stated, the present invention is a turbine shroud assembly comprising an expansion control ring defining an inner cylindrical surface. Manifolds are provided for directing a cooling fluid toward preselected locations on the expansion control ring. A spacer ring axially associates the expansion control ring with the manifolds.

DETAILED DESCRIPTION OF THE PREFERRED EMBODIMENT

Figure 1:
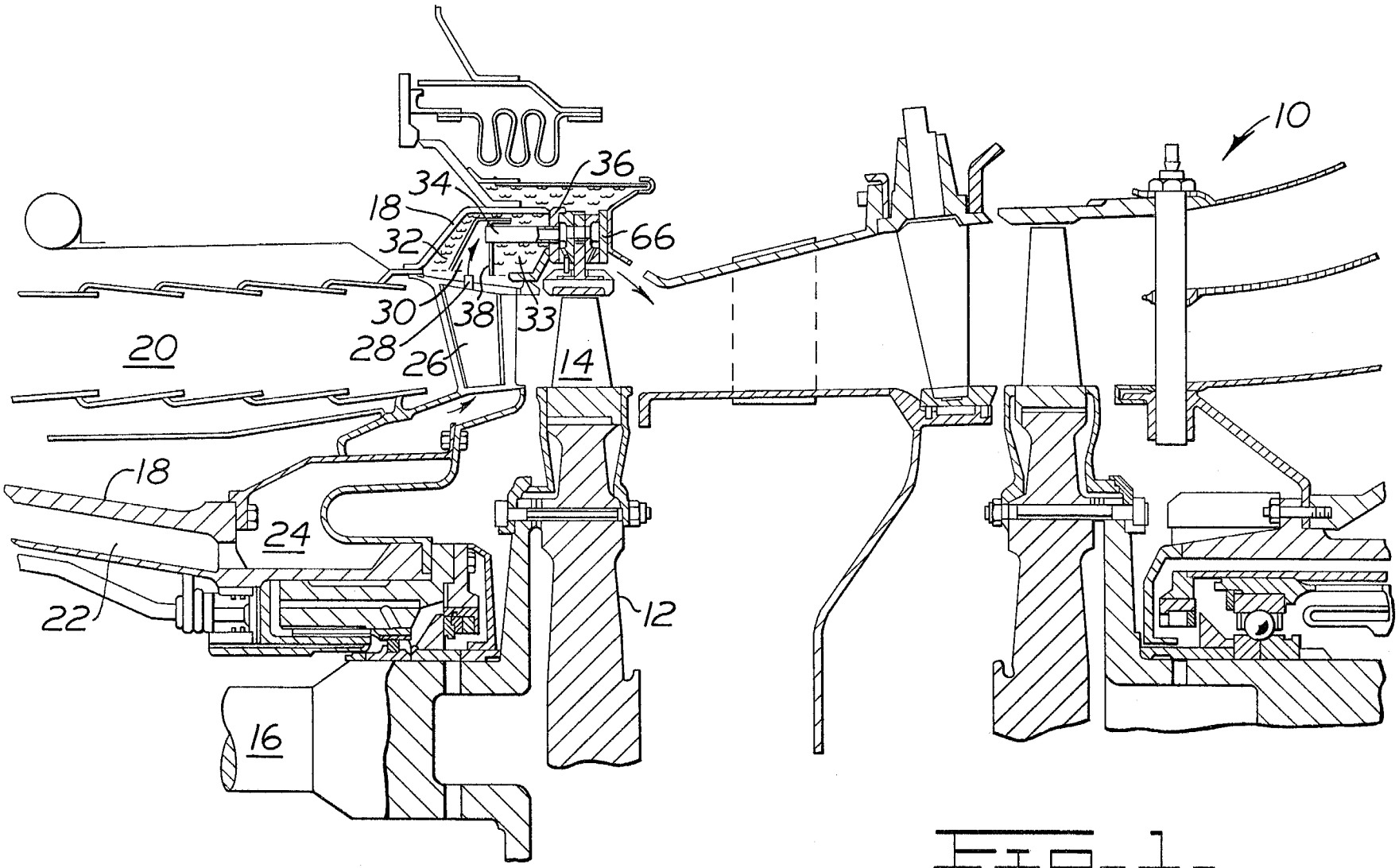
FIG. 1 is a sectional view of a portion of a gas turbine engine in which the shroud assembly described herein may be used.

A portion of a gas turbine engine 10 is shown in FIG. 1. Gas turbine engine 10 includes a gasifier turbine wheel 12 upon which a plurality of turbine vanes 14 are mounted. Turbine wheel 12 is fixed to a shaft 16 which is mounted for rotation in a turbine case 18 in which a combustion chamber 20 is also affixed. Shaft 16 rotates a compressor, (not shown) from which a quantity of cooling fluid or air is bled off to a passage 22 and communicated to plenum chamber 24 for subsequent communication to the interior of a plurality of turbine nozzle vanes 26. The cooling arrangement described thus far is more thoroughly set forth in U.S. patent application Ser. No. 729,746 now U.S. Pat. No. 4,086,757 assigned to the assignee of this invention.

Cooling fluid communicated to turbine nozzle 26 is relieved through a vent 28 into a chamber 30 which is annular in form. Chamber 30 is surrounded by insulating material 32 which may be of any material well known in the art, such as ceramic fiber. Communicating with chamber 30 are a series of tubes 34 fixed to a flange 36 which surrounds turbine wheel 12. Flange 36 is fixed to turbine case 18 and provides a portion of the support for the turbine shroud assembly 40 (see also FIGS. 2 and 5).

Affixed to the other opposite end of tubes 34 is a sheet metal member 38 which forms an annulus. Insulating material 33 is positioned in the annulus and around tubes 34 to minimize the temperature rise in the cooling fluid as it is communicated from the nozzle vane liner 26 to the turbine shroud assembly.

Figure 5:
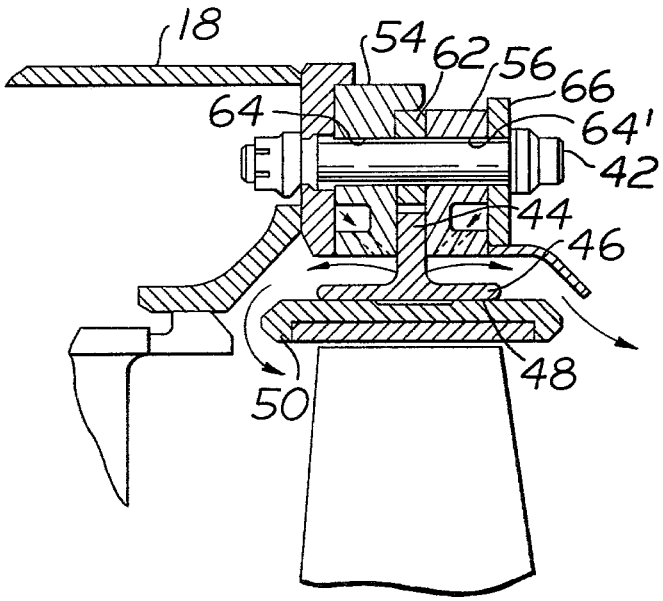
FIG. 5 is a sectional view of the turbine shroud assembly showing one of the bolt members fixing the assembly to the turbine case.

The turbine shroud assembly 40 is affixed to flange 36 by a plurality of bolt members 42 in the manner shown in FIG. 5. The shroud assembly 40 is comprised of an expansion control ring 44 which has a generally T shaped cross sectional configuration. The expansion control ring 44 defines a cross bar portion 46 which in turn has an inner cylindrical surface 48 to which a plurality of rotor segments 50 mountingly abut.

Figure 2:
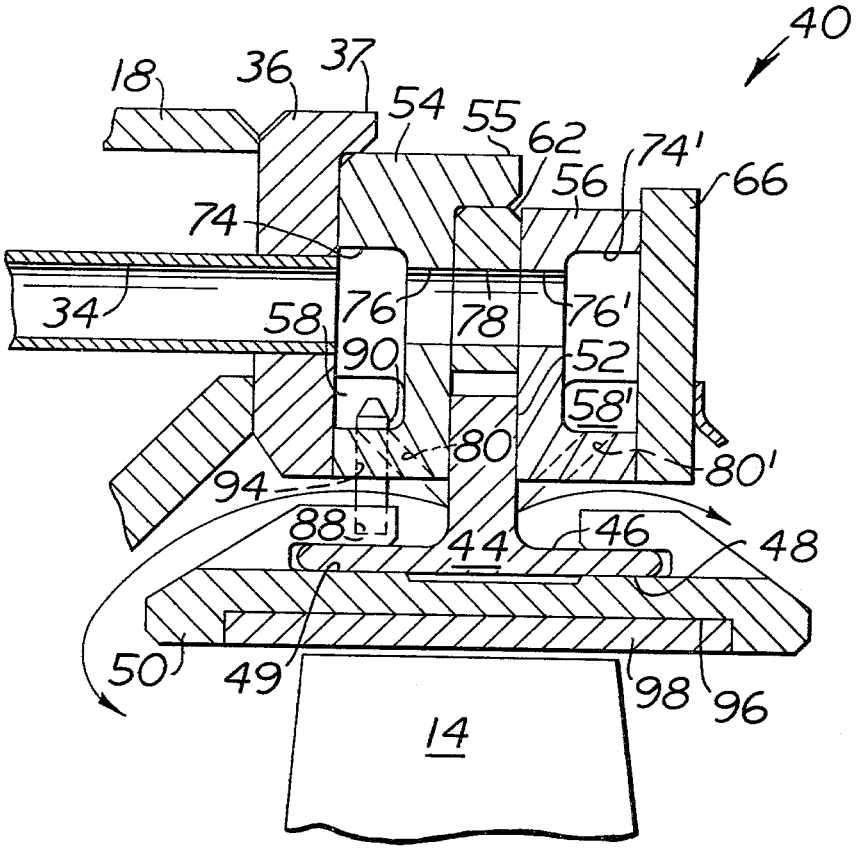
FIG. 2 is a sectional view in greater detail of the shroud assembly shown in FIG. 1 and described herein.

Extending radially outwardly from cross bar portion 46 is a leg portion 52. Positioned on opposed sides of leg portion 52 is means for forming a manifold to communicate cooling air to the intersection of leg portion 52 and cross bar portion 46. This means is comprised of first and second manifold rings 54 and 56 respectively. Manifold rings 54 and 56 are similar with structure differing on the outer perimeter thereof as indicated in FIG. 2. First and second manifold rings 54 and 56 have interposed there between and positioned radially outwardly of expansion control ring 44, a spacer ring 62 which has a width slightly greater than leg portion 52 of expansion control ring 44. Spacer ring 62 radially associates expansion control ring 44 with the manifold means.

Figure 3:
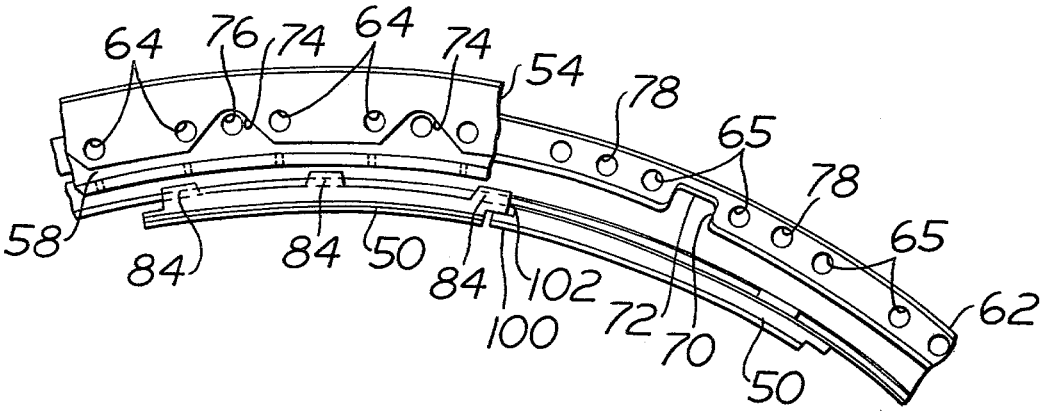
FIG. 3 is a partial elevation view of the shroud assembly shown in FIG. 2 with a portion broken away to illustrate the structure of the expansion control ring.

Referring now to FIG. 3 in conjunction with FIG. 5, it can be seen that the manifold ring 54 and manifold ring 56 are formed with a plurality of fastening holes 64 and 64' respectively. Similarly, spacer ring 62 is formed with a plurality of fastener holes 65. The plurality of bolt member 42 previously mentioned in relation to FIG. 5, are passed through these fastener holes to flange 36 and a flange 66 also affixed to turbine housing 18. It should be noted that flange 36 is formed with a rearwardly extending lip 37 at its outer periphery and overlapping manifold ring 54. The manifold ring 54 is also formed with a rearwardly extending lip 55 overlapping spacer ring 62.

The spacer ring 62 is formed with a plurality of parallel sided notches 70 adapted to receive lugs 72 formed on the outer perimeter of leg portion 52 of expansion control ring 44. Referring to FIG. 3, it can be seen that each lug 72 is mated with a corresponding notch 70 with expansion room provided between lug 72 and notch 70. Axial alignment of expansion control ring 44 with turbine wheel 12 is not affected during thermal expansion of expansion control ring 44 because the parallel sides of the notches 70 and the corresponding lugs 72 require uniform expansion of the ring. Therefore, the expansion control ring 44 may expand to a different degree from the turbine casing itself, without affecting the concentricity of expansion control ring 44.

Each manifold ring, 54 and 56, is formed with a plurality of relieved areas 74 and 74' having a generally triangular shape as indicated in FIG. 3, although other shapes would serve adequately. Each relieved area 74 and 74' communicates its widest part with the corresponding groove 58 in manifold ring 54 and the groove 58' in the manifold ring 56. A bore 76 (see FIG. 3) is formed generally at the apex of the triangular shaped relieved area 74. The bore 76 communicates with a bore 78 formed in spacer ring 62 which in turn, communicates with a corresponding bore 76' in the second manifold ring 56 as indicated in FIG. 2. This second bore 76' in turn communicates with the corresponding relieved area 74' of second manifold ring 56. A plurality of orifices or ports 80 communicate groove 58 (see FIG. 2) with the area adjacent expansion control ring 44. Specifically, each port 80 in the first manifold ring 54 is directed toward one side of the expansion control ring 44 in the vicinity of the intersection of the leg portion 52 and the cross bar portion 46. A similar plurality of ports 80' is formed in manifold ring 56, thus cooling fluid communicated through the bores 76, 78, and 76' to relieved area 74' is controlably directed towards the opposite side of expansion control ring 44 in the specific vicinity of the intersection of leg portion 52 and a cross bar portion 46.

The particular structure described to this point provides cooling to expansion control ring 44 which may be formed of a particular low expansion alloy such as "Hastelloy Alloy's". This particular material has been found to have sufficient high temperature strength for this application while retaining a relatively low co-efficient of thermal expansion. The relatively loose contact between expansion control ring 44 and the adjacent manifold rings and spacer, creates a relatively high resistance to heat conduction from adjacent engine parts which could obviate efforts to cool expansion control ring 44. The lug and notch connection between expansion control ring 44 and spacer ring 62 eliminate mechanical stresses between these two parts which would tend to resist the reduction in diameter of expansion control ring 44 resulting from cooling air applied to the intersection of leg portion 52 and cross bar portion 46.

Figure 4:
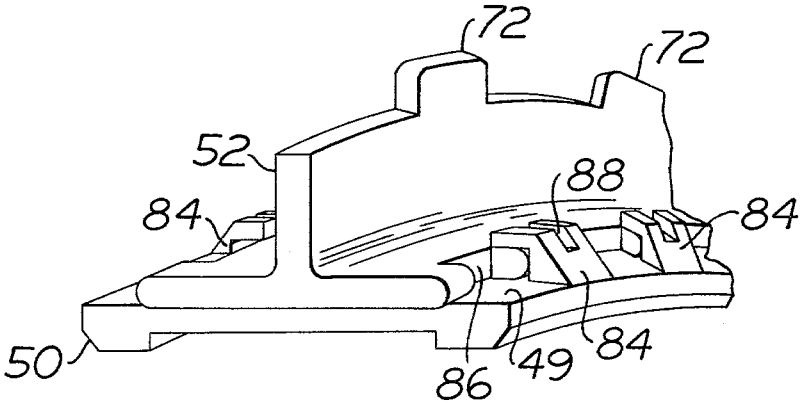
FIG. 4 is a perspective view of a portion of a rotor shroud segment shown positioned on a portion of the expansion control ring.

Referring to FIG. 4, a perspective view of a rotor shroud segment 50 is shown mounted on a portion of expansion control ring 44. Each rotor shroud segment 50 is formed with a plurality of inwardly facing tabs 84 which are formed on the outer surface 49 thereof, to overlap cross bar portion 46 of expansion control ring 44. The expansion control ring 44 has a plurality of loading notches 86 spaced at a distance substantially equal to the distance separating inwardly facing tabs 84, thus the plurality of rotor shroud segments 50 can be placed on expansion control ring 44 by orienting tabs 84 in notches 86 and then sliding the plurality of rotor shroud segments to the position indicated in FIG. 4. It will be noted that one of the two center tabs 84 has formed therein a notch 88 which forms part of a socket for a dowel 90 to be positioned in. A corresponding bore 94 is formed in manifold ring 54. Thus, it can be seen in FIG. 2 that the dowel 90 is circumferentially orients each individual rotor shroud segment 50 on expansion control ring 44. The rotor shroud segments 50 can also be made of the same low expansion alloy as expansion control ring 44. Additionally, the outer surface 49 which contacts or mates with the inner cylindrical surface 48 preferably has substantially the same radius of curvature as the mating cylindrical surface 48.

It has been found that the central location of the dowel pin 90 permits expansion of each individual rotor shroud segment 50 without affecting the expansion of the next adjacent rotor shroud segment. That is, referring to FIG. 3, each rotor shroud segment 50 expands outwardly from the center relative to expansion control ring 44 rather than expanding from a locking point at one end.

Referring to FIG. 2, a cross section of rotor shroud 50 is shown in relation to the associated turbine blade vane 14. It can be seen that rotor shroud segment 50 is formed with a longitudinal groove 96. Fixed in longitudinal groove 96 is an abradable material 98 in the manner well known in the art. This abradable material acts to protect the tip of turbine vane 14 in the event turbine vane 14 contacts the rotor shroud segment.

Referring now to FIG. 3, it can be seen that the ends of each rotor shroud segment 50 are formed to overlap one another. That is, the first end 100 overlaps the second end 102 of the next adjacent rotor shroud segment.

Referring now to FIG. 1 for a better understanding of the operation of this invention, it can be seen that cooling air is provided from the compressor portion of the turbine engine to passages formed in nozzle vanes 26. After cooling nozzles 26, the cooling air passes outwardly of each nozzle through vent 28 into chamber 30 and thence into tubes 34. Each tube 34 is insulated by material 33 such as a ceramic fiber material. This material prevents an increase of heat in the cooling air passing from nozzle vanes 26 en-route to shroud assembly 40. Air is communicated to manifold ring 54 from tubes 34 at the plurality of relieved areas 74. Concurrently, a portion of the cooling air passes from the relieved area 74, through the bores 76,78 and 76' and to relieved area 74'. The cooling air in the relieved areas 74 and 74' passes through ports 80 and 80' and is controlably directed against the intersection of leg portion 52 and cross bar portion 46 of expansion control ring 44.

As can be seen by heavy arrows in FIG. 2, cooling air passes outwardly between the rotor shroud segments 50 and the turbine casing 18 and into the main hot gas stream at locations upstream and downstream of turbine vane 14. This air flow path is particularly advantageous in that hot gases in the turbine mainstream are effectively prevented from reaching the expansion control ring.

It should be noted that the rotor shroud segments 50 are not in direct contact with the adjacent portion of the turbine casing, thus heat is not effectively conducted from the casing directly to the rotor shroud segments. The connection of each rotor shroud segment 50 to turbine casing 18 is through expansion control ring 44 and in particular, through leg portion 52. Since cooling air is controlably directed against the leg portion 52, conduction of heat from the turbine casing 18 through the leg portion 52 is lessened while the leg portion and the cross bar portion themselves are cooled by the air impinging thereupon.

Although this invention has been described in relation to a particular embodiment, it is not to be considered so limited. The invention is to be considered limited only by the appended claims.

The embodiments of the invention in which an exclusive property or privilege is claimed are defined as follows:

1. A turbine shroud assembly comprising:

an expansion control ring defining an inner cylindrical surface;

manifold means for directing a cooling fluid toward preselected locations on said expansion control ring and means for coaxially supporting said expansion control ring relative to said manifold means under varying temperature conditions;

said expansion control ring defining a generally T-shaped cross-section, including a leg and a cross-bar portion, the upper surface of the cross-bar portion of the T forming the inner cylindrical surface, the leg extending radially outwardly from said cross-bar portion;

said manifold means comprising first and second manifold rings, said first and second manifold rings being positioned on opposite sides of the leg portion of the expansion control ring and each of said first and second manifold rings defining a plurality of fluid ports, said ports being oriented toward opposite sides of the leg portion of said expansion control ring.

2. The turbine shroud assembly of claim 1 wherein the means for coaxially supporting the expansion control ring comprises a spacer ring.

3. The turbine shroud assembly of claim 1 wherein the supporting means comprises a spacer ring said spacer ring having an axial thickness slightly greater than the leg portion, said spacer ring being interposed between the first and second manifold rings and radially outside said leg portion.

4. The turbine shroud assembly of claim 3 wherein the expansion control ring defines an axis and a plurality of projecting lugs extending outwardly from the leg portion thereof at predetermined locations, and wherein the spacer ring defines a plurality of notches formed in the inner perimeter thereof, said notches each having a width substantially equal to the width of said lugs and being positioned for receiving a respective lug.

5. The turbine shroud assembly of claim 1 wherein the first and second manifold rings and the spacer ring define a plurality of aligned holes, and each of said first and second manifold rings define one and the other substantially parallel flat surfaces said one flat surface further defining a circumferential groove, and said one flat surface further defining a plurality of relieved areas communicating a predetermined number of the aligned holes of each of said first and second manifold rings with said circumferential groove.

6. The turbine shroud assembly of claim 5 wherein the manifold means comprises first and second manifold rings, said first and second manifold rings being positioned on opposite sides of the leg portion of the expansion control ring.

7. The turbine shroud assembly of claim 6 wherein the first and second manifold rings define a plurality of fluid ports, said ports being oriented toward opposite sides of the leg portion of said expansion control ring.

8. The turbine shroud assembly of claim 7 wherein each of the ports communicates the groove with the inner perimeter of respective first or second manifold rings, said ports being directed at angles sufficient for impinging fluid from said ports generally on the intersection of the leg portion and the cross bar portion of the expansion control rings.

9. The turbine shroud assembly of claim 1 wherein the shroud assembly is comprised of a plurality of segments circumferentially mounted on said inner cylindrical surface of said expansion control ring.

* * * * *